US009839277B2

(12) United States Patent
Lefevre et al.

(10) Patent No.: US 9,839,277 B2
(45) Date of Patent: Dec. 12, 2017

(54) DEVICE FOR PACKAGING A PRODUCT, IN PARTICULAR A COSMETIC PRODUCT

(71) Applicant: PARFUMS CHRISTIAN DIOR, Paris (FR)

(72) Inventors: Savine Lefevre, Compiegne (FR); Francois Gautier, Colombes (FR)

(73) Assignee: PARFUMS CHRISTIAN DIOR, Paris (FR)

( * ) Notice: Subject to any disclaimer, the term of this patent is extended or adjusted under 35 U.S.C. 154(b) by 0 days.

(21) Appl. No.: 14/654,002

(22) PCT Filed: Dec. 16, 2013

(86) PCT No.: PCT/FR2013/053087
§ 371 (c)(1),
(2) Date: Jun. 19, 2015

(87) PCT Pub. No.: WO2014/096651
PCT Pub. Date: Jun. 26, 2014

(65) Prior Publication Data

US 2016/0183661 A1 Jun. 30, 2016

(30) Foreign Application Priority Data

Dec. 20, 2012 (FR) ..... 12 62414

(51) Int. Cl.
*A45D 40/02* (2006.01)
*A45D 34/04* (2006.01)
(Continued)

(52) U.S. Cl.
CPC ..... *A45D 40/02* (2013.01); *A45D 34/043* (2013.01); *A45D 40/10* (2013.01); *A45D 40/12* (2013.01); *A45D 2034/005* (2013.01)

(58) Field of Classification Search
CPC ..... A45D 40/02; A45D 40/10; A45D 40/12; A45D 40/205; A45D 40/207; B43K 24/02; B43K 24/04; B43K 24/06
(Continued)

(56) References Cited

U.S. PATENT DOCUMENTS 1,825,895 A 10/1931 Younghusband
2,813,511 A * 11/1957 Kersten ..... B43K 24/03 30/367

(Continued)

FOREIGN PATENT DOCUMENTS

GB 122565 1/1919
WO 97/09901 3/1997

OTHER PUBLICATIONS

International Search Report, dated Feb. 18, 2014; PCT/FR2013/053087.

*Primary Examiner* — Jennifer C Chiang
*Assistant Examiner* — Bradley Oliver
(74) *Attorney, Agent, or Firm* — Hamre, Schumann, Mueller & Larson, P.C.

(57) ABSTRACT

The device comprises: a casing (10) having an open end (10'); a composition support (12) that is movable in the casing between a retracted position and an extended position; and a control piece (16) that is suitable for being moved so as to cause the support to move. The device further comprises first and second magnetic elements (20, 22) that are secured to the support (12) and to the control piece (16) respectively. When the piece is in its first position and when the support is in its retracted position, the magnetic forces between these elements hold the support. When the control piece is moved, the magnetic forces are reduced and enable the support to move towards its extended position.

14 Claims, 3 Drawing Sheets

(51) Int. Cl.
*A45D 40/10* (2006.01)
*A45D 40/12* (2006.01)
*A45D 34/00* (2006.01)

(58) Field of Classification Search
USPC ..... 401/100
See application file for complete search history.

(56) References Cited

U.S. PATENT DOCUMENTS 2,849,738 A * 9/1958 Hopkins ..... A46B 11/0013 401/100
2,866,993 A * 1/1959 Edelstone ..... A45D 34/043 15/184
3,063,419 A * 11/1962 Parker ..... B43K 24/02 335/285
3,162,304 A 12/1964 Bau
4,238,163 A 12/1980 Hung
6,588,958 B1 7/2003 Seidler
6,890,115 B2 5/2005 Le Moing
8,066,443 B2 11/2011 Thiebaut et al.
8,821,057 B2 * 9/2014 Lambert ..... A45D 40/18 206/385
2004/0213624 A1 * 10/2004 Petit ..... A45D 40/02 401/100
2004/0228671 A1 * 11/2004 Sunatori ..... B43K 23/001 401/100
2007/0025802 A1 2/2007 Dieudonat et al.
2009/0175672 A1 * 7/2009 Killion ..... B43K 23/001 401/100
2011/0020049 A1 1/2011 Liu
2011/0033219 A1 2/2011 Da Rovare
2011/0315161 A1 12/2011 Lim et al.
2012/0027499 A1 2/2012 Hermouet
2012/0057920 A1 * 3/2012 Rolion ..... B43K 24/02 401/100
2015/0342321 A1 * 12/2015 Lefevre ..... A45D 34/02 401/62

* cited by examiner

DEVICE FOR PACKAGING A PRODUCT, IN PARTICULAR A COSMETIC PRODUCT

The present invention provides a packaging device for packaging a composition, in particular a cosmetic composition, the device comprising: a casing having an open end; a composition support that is movable in the casing between a retracted position and an extended position that provides access to the composition via said open end; and a control piece that is suitable for being moved so as to cause the support to move from its retracted position to its extended position.

Devices of this type are known, in particular for cosmetic compositions of the lipstick, cream, and spray, e.g. mini-spray, type. This type of composition should be easy to carry, e.g. in a bag or a handbag, and should be easy to use frequently. Thus the packaging device should be light and compact, and the composition that it contains should be easy to extract, i.e. requiring little effort and being simple to do, without the user having to pay any particular attention when handling it. It should also be possible to return the device into its retracted position by means of a simple action, likewise not requiring any particular attention on the part of the user. In addition, the device must return to its retracted position and stay in this position in reliable manner, i.e. the support must not pass accidentally into its extended position.

Devices of this type are known in which the support is retained in its retracted position inside the casing by clipping or snap-fastening. Thus, in order to cause the support to pass into its extended position, the control piece must be actuated so as to cause one or more resilient clip or snap-fastener parts to flex until they escape from the complementary parts that hold them. Conversely, in order to return the composition into its retracted position, the support must be put back into place until it engages once again with the clip or snap-fastener means.

This type of device is advantageous in that it can be compact. However, the actions required are relatively complex, or, at the least, they may require a relatively large force for disengaging the clip or snap-fastener means. Conversely, if the means are adjusted so that the force required is small, there exists a risk of the means becoming disengaged unintentionally, and thus causing the composition contained in the device to become separated unintentionally from its casing. In addition, after frequent handling, the risk of wear, in particular associated with the friction involved while engaging and disengaging the clip or snap-fastener means, ends up being detrimental to the reliability of the device.

The invention seeks to remedy the above-mentioned drawbacks by proposing a device that can be handled simply and reliably, given the above-described constraints.

This object is achieved by means of the fact that the device of the invention further comprises first and second magnetic elements that are secured to the support and to the control piece respectively, the fact that, when the control piece is in its first position and when the support is in its retracted position, the magnetic elements generate magnetic forces between them, which magnetic forces are suitable for holding said support in its retracted position, and the fact that movement of the control piece, moving said control piece away from its first position, reduces said magnetic forces, so as to enable the support to move towards its extended position.

Thus, with the device of the invention, the support is held in its retracted position by the magnetic forces that are generated between the magnetic elements. Consequently, the holding means do not make use of friction or snap-fastening forces. There is therefore no risk of wear by friction. In addition, in order cause the support to pass from its retracted position to its extended position, it suffices to move the two magnetic elements apart from each other, so that the magnetic forces weaken and cease holding the support in its retracted position. The user has an impression of movement that is continuous, without it being necessary to overcome a hard point, or the like, in order to make such movement possible. When the composition is put back into place and when the support is returned into its retracted position from its extended position, the movement of the support reaches a point from which the magnetic forces become sufficiently strong to attract the support into its retracted position. Thus, even if the user does not pay attention while handling the device and moves the support towards its retracted position without pushing it all the way into its retracted position, the support reaches its retracted position on its own as a result of the magnetic forces involved. The system is thus particularly reliable. It should also be observed that the magnetic elements may be made with very small dimensions, and consequently do not affect the overall size of the device. By way of example, the two magnetic elements may be magnets. Provision may also be made for only one of the magnetic elements to be a magnet, the other element thus being a piece made out of a material that is sensitive to the magnetic field generated by the magnet, e.g. a material containing iron. Each of the magnetic elements may be constituted by a single piece, or by a plurality of small pieces that are arranged in such a manner as to promote a uniform distribution of magnetic forces and of masses.

Advantageously, the support is moved between its retracted position and its extended position essentially or solely by sliding in translation.

Advantageously, the device further comprises thrust means that, when the control piece is moved away from its first position, are suitable for causing the support to move towards its extended position.

The thrust means also make it easier to handle the device for passing the support from its retracted position to its extended position. Specifically, once the magnetic forces are reduced sufficiently, the thrust means overcome them and bring the support into its extended position themselves.

Advantageously, the thrust means comprise a spring. It is also advantageous for the spring to be arranged between the support and the bottom end wall of the casing, which bottom end wall is remote from the open end of said casing.

The spring may be a helical spring that is simple to manufacture and inexpensive.

Advantageously, the control piece is secured to an actuator that is arranged on the outside of the casing, and that is suitable for being handled so as to move said control piece.

The actuator may be made in a shape that is of suitably attractive appearance, and it may project a little from the outer periphery of the casing. The control piece is moved by moving said actuator. Provision could be made for the actuator and the control piece to be made integrally as a single piece. Provision should also be made for the actuator to be a decorative portion that is fastened on the control piece and that is constrained to move therewith. Between the actuator and the control piece, movement transmission means may also be provided, e.g. using a tab or the like.

Preferably, the actuator is designed for moving over a limited stroke.

Advantageously, the actuator is a ring that is arranged around the casing.

Generally, the stroke of the support between its retracted position and its extended position is relatively long, since it must provide easy access to the composition housed in the support. In general, the stroke is of the order of at least 1 centimeter (cm) or 2 cm. However, it is advantageous to make provision for the actuator to be moved over a limited stroke only. For example, when the thrust means are present, provision could be made for the movement of the actuator to be just sufficient to cause a reduction in the magnetic-attraction forces between the first and second elements, making it possible for the force exerted by the thrust means to exceed the amplitude of the magnetic-attraction forces and thus making it possible, once the threshold is crossed, to cause the support to pass from its retracted position to its extended position. When the actuator is made in the form of a ring that surrounds the casing, it may be handled without any precaution, practically as a reflex action.

In one possibility, the actuator is suitable for being moved in translation.

Provision may be made for the support and the actuator to move in translation and in the same direction, thereby enabling the moving parts to be particularly simple.

In another possibility, the actuator, which as stated above may be a ring, is suitable for being turned.

This possibility is valid in particular when the first and second magnetic elements are positioned angularly relative to each other so as to be capable of facing each other in a first position of the actuator, and of being offset after turning the actuator. This variant is also simple to implement and may be made to be compact.

Advantageously, when the control piece is in its first position and when the support is in its retracted position, the first and second magnetic elements face each other in a segment of the device that extends transversely to the movement direction of the support, which movement is movement in translation in particular.

This arrangement makes it possible for the magnetic elements to occupy a small space, and to arrange for a small movement of the control piece, taking with it the second magnetic element, to cause a clear reduction in the magnetic-attraction force between the first and second magnetic elements, thereby enabling the support to pass easily from its retracted position to its extended position.

In this configuration, the stroke of the actuator advantageously corresponds substantially to the thickness of said segment, measured along the movement direction of the support.

Whatever the embodiment variant, it is also advantageous for the device to include return means for returning the control piece into its first position.

These means may take the form of return means of the spring type, e.g. a helical spring or a leaf spring.

The invention can be well understood and its advantages appear better on reading the following detailed description of an embodiment shown by way of non-limiting examples. The description refers to the accompanying drawings, in which.

The device shown in FIGS. 1 to 4 comprises a casing 10 having an open end 10' and a bottom end wall 10" that is remote from the open end. The casing 10 is generally cylindrical in shape. Specifically, it comprises a "bottom" portion 10A and a "top" portion 10B. The bottom end 10B' of the top portion 10B is engaged in the top end 10A' of the bottom portion 10A. The two portions 10A and 10B may be fastened together by any appropriate means, e.g. merely by force-fitting the end 10B' in the end 10A', or by adhesive-bonding, heat-sealing, or similar.

Figure 1:
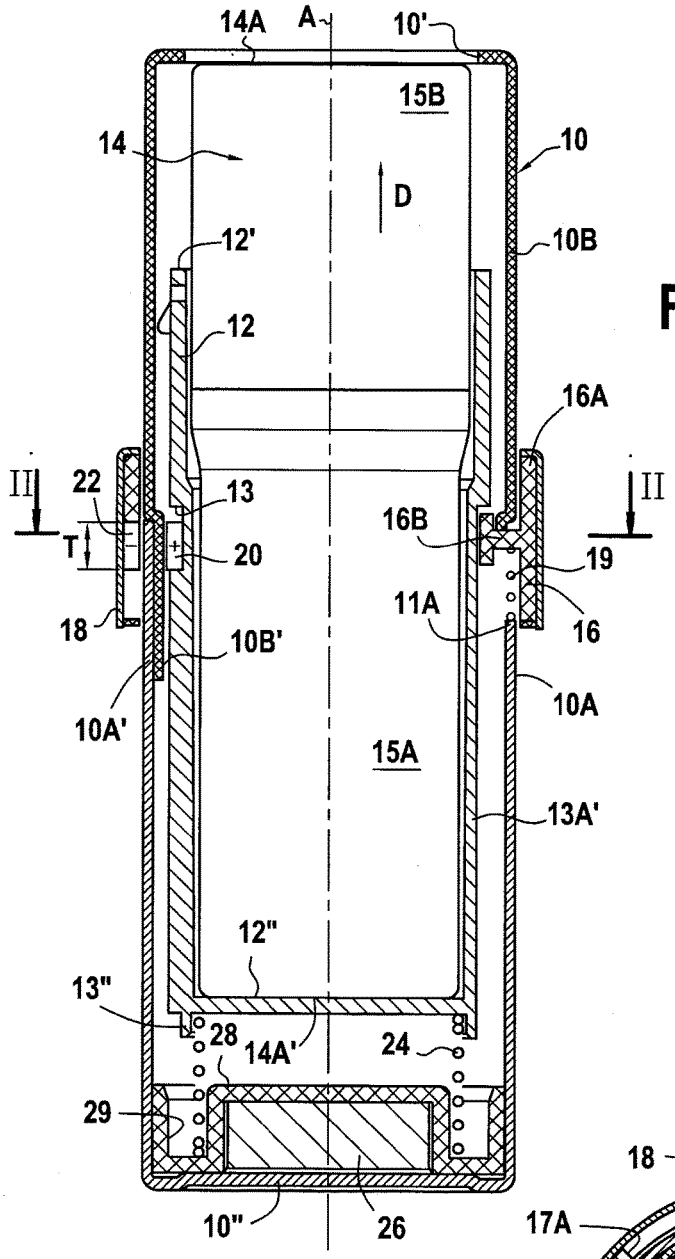
FIG. 1 is a section view of the device of the invention, taken parallel to the movement axis A of the support, said support being shown in its retracted position.

A support 12 of generally cylindrical shape is situated inside the casing 10. In FIG. 1, the support 12 is in its retracted position. Specifically, it can be seen that it is arranged towards the bottom end wall 10" of the casing 10 so that the article 14 arranged in the support 12 is itself retracted into the casing, the top end 14A of the article 14 projecting little, or not at all, through the opening at the end 10' of the casing. Specifically, the support 12 has an open top end 12' and a closed bottom end 12" against which the bottom end of the article 14 bears.

Figure 4:
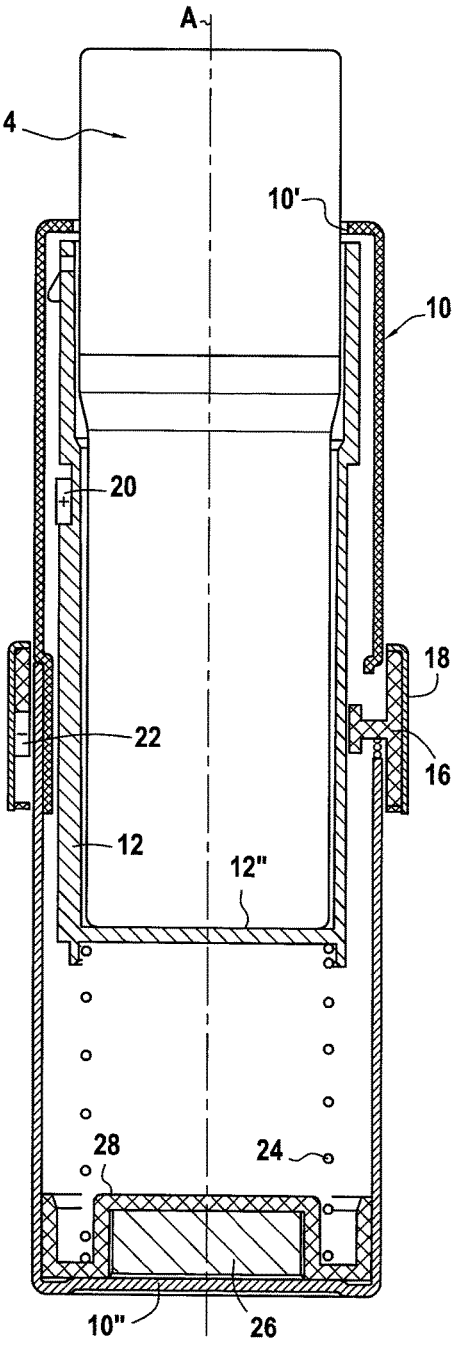
FIG. 4 is a section similar to the sections in FIGS. 1 and 3, but showing the support in its extended position.

In the meaning of the present patent application, the upward direction is in direction D along which the support slides so as to pass from its retracted position shown in FIG. 1 to its extended position shown in FIG. 4. The terms "bottom" and "top" are used accordingly.

Towards the junction between the bottom and top portions 10A, 10B of the casing 10, the device includes a control piece 16 on which a decorative bushing 18 is crimped.

Figure 3:
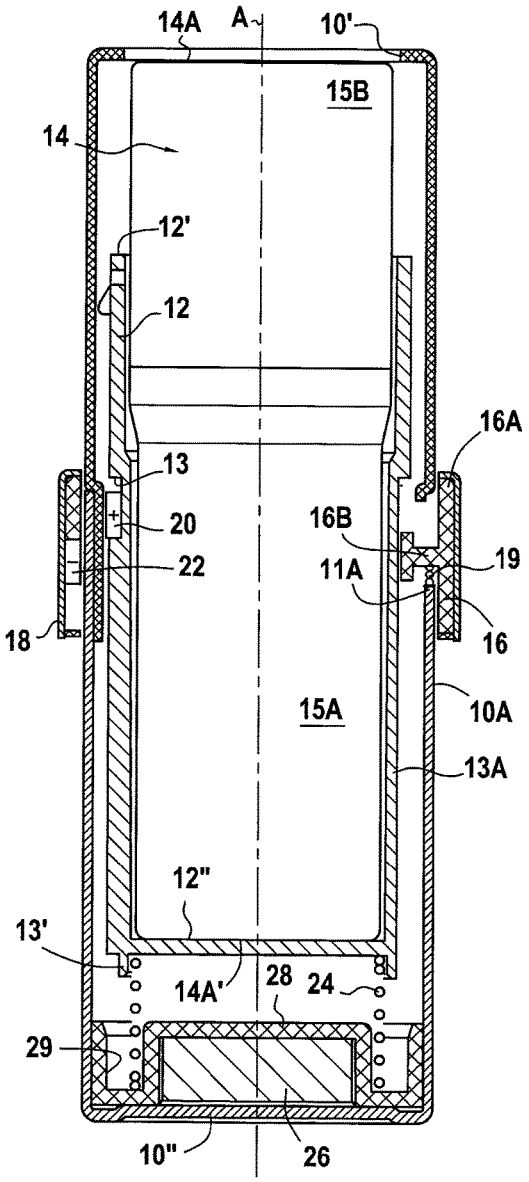
FIG. 3 is a section similar to the section in FIG. 1, after the control piece has been moved, the support still being in its retracted position.

As can be seen in FIGS. 1 and 3, the support 12 carries a first magnetic element 20, while the control piece carries a second magnetic element 22.

In FIG. 1, the support is in its retracted position, and it can be seen that the first and second magnetic elements 20 and 22 are facing each other. Magnetic forces are thus exerted between them, which magnetic forces hold the support in its retracted position. In FIG. 3, the control piece 16 has been moved, such that the second magnetic element 22 is spaced apart from the first magnetic element 20, so as to enable the support 12 to pass from its retracted position to its extended position. In FIG. 4, the extended position is reached.

In the embodiment shown, the device includes a spring 24 that is arranged between the bottom end wall 12" of the support 12, and the bottom end wall 10" of the casing 10. The spring exerts a return force on the support 12 continuously, tending to urge it towards its extended position. While the first and second magnetic elements remain facing each other, as shown in FIG. 1, the magnetic forces generated between the elements are of amplitude that is greater than the return force exerted by the spring, such that the support remains in its retracted position. In contrast, as a result of the above-mentioned movement of the control piece 16, the amplitude of the magnetic forces exerted between the first and second magnetic elements decreases sufficiently to be exceeded by the amplitude of the return force exerted by the spring, so as to enable the support to pass automatically from its retracted position to its extended position. This is the position shown in FIG. 4.

Figure 2:
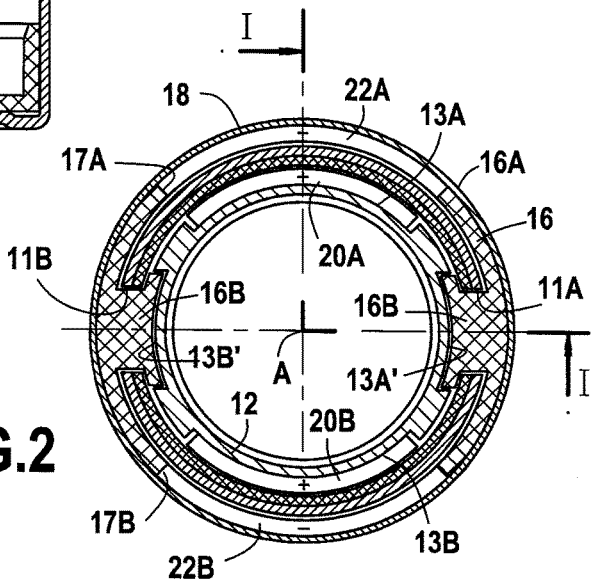
FIG. 2 is a section on plane II-II in FIG. 1, the line I-I on which the section in FIG. 1 is taken, being shown in FIG. 2.

In the embodiment shown, the first magnetic element is arranged in a groove 13 in the outer periphery of the cylindrical wall of the support 12. As can be seen in FIG. 2, in the embodiment shown it has been decided to make the first magnetic element 20 in the forms of two parts, respectively 20A and 20B, that are diametrally opposite and that are arranged in two groove portions 13A and 13B respectively in the wall of the support 12. Likewise, the second magnetic element is made specifically in the form of two parts, 22A and 22B respectively, that are arranged in recesses 17A and 17B in the control piece 16.

As can be seen in FIG. 1, when the control piece 16 is in its first position, and when the support 12 is in its retracted position, the first and second magnetic elements face each other in an axial segment T of the device, which segment extends transversely to the sliding direction D of the support. The thickness of the segment, measured parallel to the direction D, itself parallel to the axis A, corresponds substantially to the axial height of the magnetic elements 20 and 22. In this arrangement, the parts 20A, 20B, 22A, and 22B that form the first and second magnetic elements are specifically in the shape of circular arcs. The magnetic elements are thus compact both in the axial direction and in the radial direction of the device.

In the embodiment shown, the control piece 16 presents firstly an outer portion 16A that forms a ring that is interrupted locally so as to present recesses 17A and 17B in which the parts 22A and 22B of the second magnetic element 22 are housed. The outer portion 16A is arranged against the outer wall of the casing 10, and thus slides against said casing while the control piece is moving.

The control piece also presents inner ribs 16B that are directed radially inwards, i.e. towards the axis A. In the embodiment shown, and as can be seen better in FIG. 2, there are two inner ribs and they pass through slots 11A and 11B that are formed in the wall of the casing 10, at the junction between its bottom and top portions 10A, 10B. As can be seen in FIG. 2, the inner ribs make it possible to block the control piece 16A relative to the casing, so as to prevent it turning about the axis A, relative to the casing.

Correspondingly, the casing presents outer longitudinal grooves 13A' and 13B' respectively receiving the inner radial heads of the ribs 16B. This makes it possible firstly to guide the support 12 while it is moving in translation between its retracted position and its extended position, and secondly to prevent the support and the control piece 16 from turning relative to each other. For example, the inner radial heads of the ribs 16B may be enlarged and present a dovetail shape that thus co-operates with a corresponding shape of the grooves 13A' and 13B'.

The ring 18 that is crimped on the control piece 16 has a decorative function. In addition, it is this ring that forms the actuator that is handled by the user so as to cause the control piece to move. Specifically, as a result of the ring 18 being crimped on, the control piece 16 and the ring 18 act as a single piece.

Specifically, the stroke of the actuator 18 and thus also the stroke of the control piece 16 are limited by the height of the slots 11A and 11B formed in the wall of the casing. As can be seen by comparing FIGS. 1 and 3, the stroke is sufficient for the movement of the control piece 16 to cause the second magnetic element to leave the above-mentioned axial segment T. Thus, in the position shown in FIG. 3, the magnetic forces between the magnetic elements 20 and 22 are reduced sufficiently to enable the support 12 to pass from its retracted position to its extended position.

In the embodiment shown, to enable the device 10 to be positioned naturally, with the open end 10' of the casing towards the top, the device includes a ballast weight 26 that is arranged on the bottom end wall of the casing. Specifically, the ballast weight 26 is held between the bottom end wall of the casing and a cap-forming washer 28 that is arranged on the bottom end wall of the casing 10, and that presents an inner cavity that is suitable for receiving the ballast weight. The cap 28 may be secured to the bottom end wall of the casing by any appropriate means, e.g. by force-fitting. On its peripheral portion, the washer 28 presents an annular groove 29 that opens upwards and in which the bottom end of the spring 24 is received. The top end of the spring 24 is blocked inside an annular extension 13" of the bottom end wall 12" of the support. Thus, the spring 24 that is a helical spring working in compression, is blocked between the casing 10 and the support 12.

In the embodiment described above with reference to FIGS. 1 to 4, the control piece 16 moves in translation so as to enable the support to pass from its retracted position to its extended position. In a variant, provision could be made for the piece turn for the same purpose.

Figure 5:
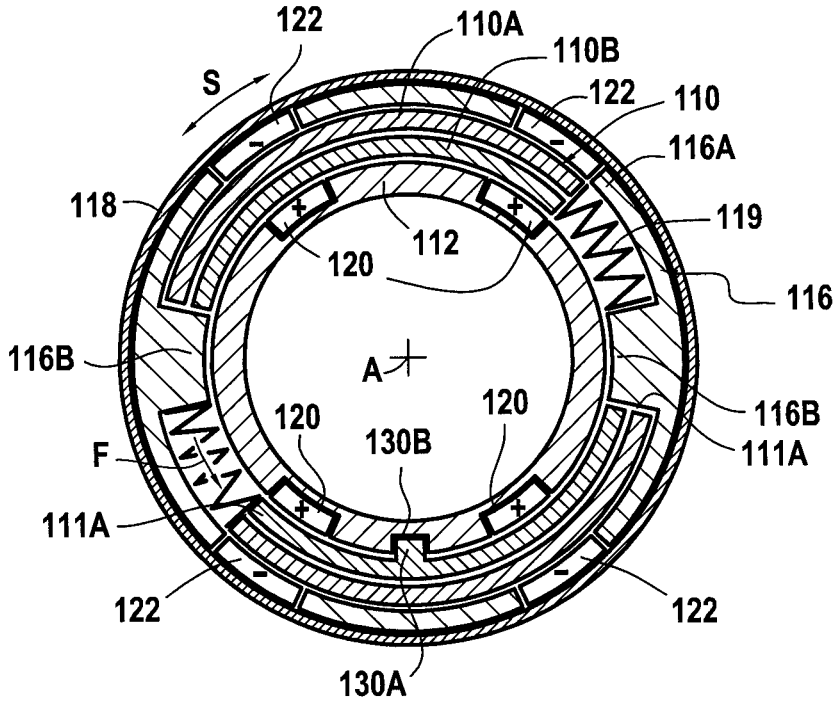
FIG. 5 shows a variant embodiment, in a section corresponding to the section in FIG. 2.

FIG. 5 shows an embodiment of this variant. In this figure, elements that correspond functionally to elements of the preceding figures, but that are modified a little, are given the same reference plus 100. The support 112 is similar to the support 12, except that, in the embodiment shown, the first magnetic element that is carries is made specifically in the form of four parts 120 that are regularly distributed angularly in corresponding cavities of the outer wall of the support. The control piece 116 is generally the shape of a ring and carries the second magnetic element that, in the embodiment shown, is made in the form of four parts 122 that are regularly distributed angularly in correspondence with the parts that form the first magnetic element 120. The control piece 116 presents a cylindrical outer portion 116A and two ribs 116B that project radially inwards, i.e. towards the axis A. The two ribs pass through slots 111A in the casing that, as in the preceding figures, is made up of two portions, respectively a bottom portion 110A and a top portion 110B, the slots 111A being formed in the junction zone between the bottom and top portions.

The slots cover an angular sector that is sufficient to enable the control piece 116 to turn about the axis A. In the position shown, corresponding to the retracted position of the support, the ribs 116B are situated against respective first edges of the slots 111A. It should be understood that by turning the control piece in the direction of arrow F, the ribs 116B come to be positioned towards the opposite edges of the slots 111A. Such turning takes the second magnetic element 122 with it, thus placing the second magnetic element outside the angular sector S covered by the first magnetic element 120. More precisely, the various parts that make up the first and second magnetic elements are initially arranged facing each other in the angular sectors S. Moving the control piece causes the parts that make up the second magnetic elements to move away from the angular sectors S. This serves to reduce the magnetic-attraction forces between the first and second magnetic elements, and thus enables the support to pass from its retracted position to its extended position, in the same way as described with reference to FIGS. 1 to 4.

In this variant, means are advantageously provided for preventing the support from turning relative to the casing. The means may be made merely in the form of grooves and splines that are parallel to the axis A, that are provided respectively on each of the two elements, and that co-operate with each other. By way of example, FIG. 5 shows that the casing 110, e.g. its bottom portion, may present a spline 130A, while the support may present a groove 130B, the splines and grooves being oriented longitudinally and thus forming a guide track while the support is moving, also making it possible to prevent the support from turning relative to the casing.

As in the embodiment described with reference to FIGS. 1 to 4, the control piece may be surrounded by a crimped ring 118 that forms the actuator that is handled by the user.

The device of the FIG. 5 variant may present the spring 24, the ballast weight 26, and the cap of the embodiment in the preceding figures.

In the embodiments shown, the first and second magnetic elements are magnets with opposite polarities, such that they attract each other. Provision can also be made for one of the two magnetic elements to be a piece that is sensitive to the magnetic field generated by a magnet, and, by way of example, to be made of iron that is sensitive to magnetic forces.

Thus, as can be seen better in FIGS. 1, 3, and 4, the packaging device serves to house an article 14. Said article is shown in extremely diagrammatic manner in the drawings. In general, the article carries a body, which is the portion 14 shown diagrammatically in the drawings, containing a cosmetic composition. The body may be a lipstick holder, or, by way of example, the body of a spray, or an applicator tube for applying cream. In the embodiment shown, the body presents two sections of diameters that are different, a bottom section 15A that is arranged towards the bottom end wall of the support, and a top section 15B that is arranged towards the top portion of the support. By way of example, for a lipstick holder, the portion 15B may turn relative to the portion 15A so as to cause the stick to extend via the open free and 14A' of the portion 15B.

The body 14 is received in the support in removable manner. In order to avoid accidental disengagement, provision may be made for the inner periphery of the support to present resilient holder means, e.g. beads that project radially inwards and that are elastically deformed a little when the article is in place.

Provision could be made for the control piece 16 or 116 to be returned automatically into its first position after being operated. To this end, the spring-type resilient return means may be arranged between the rib 16B or 116B of the control piece 16 or 116 and the opposite edge of the slot of the casing in which it is arranged. By way of example, such a spring 19 is shown in FIG. 1, and a spring 119 is shown in FIG. 5.

The invention claimed is:

1. A packaging device for packaging a composition, the device comprising:

a casing having an open end; a composition support that is movable in the casing between a retracted position and an extended position that provides access to the composition via said open end; and a control piece that is suitable for being moved so as to cause the support to move from its retracted position to its extended position;

first and second magnetic elements that are secured to the support and to the control piece respectively, wherein when the control piece is in its first position and when the support is in its retracted position, the magnetic elements generate magnetic forces between them, which magnetic forces are suitable for holding said support in its retracted position, and wherein movement of the control piece, moving said control piece away from its first position to a second position, reduces said magnetic forces, so as to enable the support to move towards its extended position, the control piece being attached to the casing in both the first position and the second position; and a spring that, when the control piece is moved away from its first position, is suitable for causing the support to move towards its extended position.

2. A device according to claim 1, wherein when the control piece is moved away from its first position, the support is caused to move towards its extended position.

3. A device according to claim 1, wherein the spring is arranged between the support and the bottom end wall of the casing, which bottom end wall is remote from the open end of said casing.

4. A device according to claim 1, wherein the control piece is secured to an actuator that is arranged on the outside of the casing, and that is suitable for being handled so as to move said control piece.

5. A device according to claim 4, wherein the actuator is a ring that is arranged around the casing.

6. A device according to claim 4, wherein the actuator is configured to be moved in translation so as to move the control piece.

7. A device according to claim 6, wherein the stroke of the actuator is shorter than the stroke of the support.

8. A device according to claim 4, wherein the actuator is configured to be turned so as to move the control piece.

9. A device according to claim 4, wherein when the control piece is in its first position and when the support is in its retracted position, the first and second magnetic elements face each other in a segment of the device that extends transversely to the movement direction of the support.

10. A device according to claim 9, wherein a stroke of the actuator corresponds substantially to a thickness of said segment, measured along the movement direction of the support.

11. A device according to claim 1, wherein the control piece is returned into its first position.

12. A device according to claim 1 wherein one of the two magnetic elements is a magnet, the other of said elements being one of a magnet and a piece made out of a material that is sensitive to the magnetic field generated by the magnet.

13. A device according to claim 1, comprising a cosmetic article having a body that contains a cosmetic composition, and that is received by the support in removable manner.

14. A packaging device for packaging a composition, the device comprising:

a casing having an open end; a composition support that is movable in the casing between a retracted position and an extended position that provides access to the composition via said open end; and a control piece that is suitable for being moved so as to cause the support to move from its retracted position to its extended position;

first and second magnetic elements that are secured to the support and to the control piece respectively, wherein when the control piece is in its first position and when the support is in its retracted position, the magnetic elements generate magnetic forces between them, which magnetic forces are suitable for holding said support in its retracted position, and wherein movement of the control piece, moving said control piece away from its first position, reduces said magnetic forces, so as to enable the support to move towards its extended position;

the control piece is secured to an actuator that is arranged on the outside of the casing, and that is suitable for being handled so as to move said control piece;

when the control piece is in its first position and when the support is in its retracted position, the first and second magnetic elements face each other in a segment of the device that extends transversely to the movement direction of the support; and a stroke of the actuator corresponds substantially to a thickness of said segment, measured along the movement direction of the support.

* * * * *